US007878598B2

(12) United States Patent
Oda

(10) Patent No.: US 7,878,598 B2
(45) Date of Patent: Feb. 1, 2011

(54) BASE PLATE FOR A CHAIR

(75) Inventor: Yoichiro Oda, Kanagawa (JP)

(73) Assignee: Okamura Corporation, Kanagawa (JP)

( * ) Notice: Subject to any disclaimer, the term of this patent is extended or adjusted under 35 U.S.C. 154(b) by 301 days.

(21) Appl. No.: 12/093,673

(22) PCT Filed: Nov. 2, 2006

(86) PCT No.: PCT/JP2006/321943

§ 371 (c)(1),
(2), (4) Date: May 14, 2008

(87) PCT Pub. No.: WO2007/055145

PCT Pub. Date: May 18, 2007

(65) Prior Publication Data

US 2009/0224593 A1 Sep. 10, 2009

(30) Foreign Application Priority Data

Nov. 14, 2005 (JP) ..... 2005-328348

(51) Int. Cl.
*A47C 7/02* (2006.01)

(52) U.S. Cl. ..... 297/452.15; 297/452.29; 297/452.21

(58) Field of Classification Search ..... 297/452.15, 297/452.14, 440.2, 452.64, 451.11, 452.46, 297/452.21, 452.29
See application file for complete search history.

(56) References Cited

U.S. PATENT DOCUMENTS

| | | | | |
|---|---|---|---|---|
| 3,054,643 | A * | 9/1962 | Militano | 297/440.2 |
| 4,368,917 | A * | 1/1983 | Urai | 297/452.54 |
| 4,418,958 | A * | 12/1983 | Watkin | 297/452.15 |
| 2002/0060492 | A1 | 5/2002 | Nagamitsu et al. | |
| 2004/0183350 | A1 | 9/2004 | Schmitz et al. | |

FOREIGN PATENT DOCUMENTS

| | | |
|---|---|---|
| DE | 10151166 A1 | 5/2002 |
| JP | 2000-270962 | 10/2000 |
| JP | 2001-128788 | 5/2001 |
| JP | 2005-160558 | 6/2005 |

* cited by examiner

*Primary Examiner*—Milton Nelson, Jr.
(74) *Attorney, Agent, or Firm*—Davis & Bujold, P.L.L.C.

(57) ABSTRACT

A flexible base board for a chair, easily bends into a desirable shape. The base board fits more appropriately to the body of the person seated on the chair following the shape of the person's body without pressing the back, etc., thereby providing the person with good sitting comfort. The flexible base board is used for the backrest, etc. of a chair. The base board has an upper shell (4), an intermediate shell (5), and a lower shell (6). A large number of holes (14) having substantially the same size are substantially uniformly formed in the entire shell (6). Also, a large number of holes (15) are formed in the entire surface of the intermediate shell (5), and each hole (15) has a greater transverse width than a hole (14) in the upper shell (4) and the lower shell (6).

6 Claims, 4 Drawing Sheets

BASE PLATE FOR A CHAIR

TECHNICAL FIELD

The present invention relates to a base plate for a chair and particularly to a base plate suitable for the backrest of a chair and variable in shape depending on the back of an occupant who sits on the chair.

BACKGROUND OF THE INVENTION

A base plate for the backrest of a chair may preferably have a curved support surface fitting the back of an occupant for a chair. For example, JP2000-270962A and JP2001-128788A disclose a base plate for the backrest of a chair having a flexible curved surface following the back of the occupant.

The base plate for the backrest in the Japanese publications is likely to bend depending on the back of the occupant, but it is not sufficient to provide flexibility in the intermediate part mainly supporting the back of the occupant. It is necessary to improve sitting comfort.

SUMMARY OF THE INVENTION

In view of the disadvantages above, it is an object of the invention to provide a base plate for a chair, the base plate being flexible when an occupant reclines on the backrest to allow the base plate to fit the body of the occupant without pressurizing the back thereby providing good sitting comfort.

DETAILED DESCRIPTION OF PREFERRED EMBODIMENT

Figure 1:
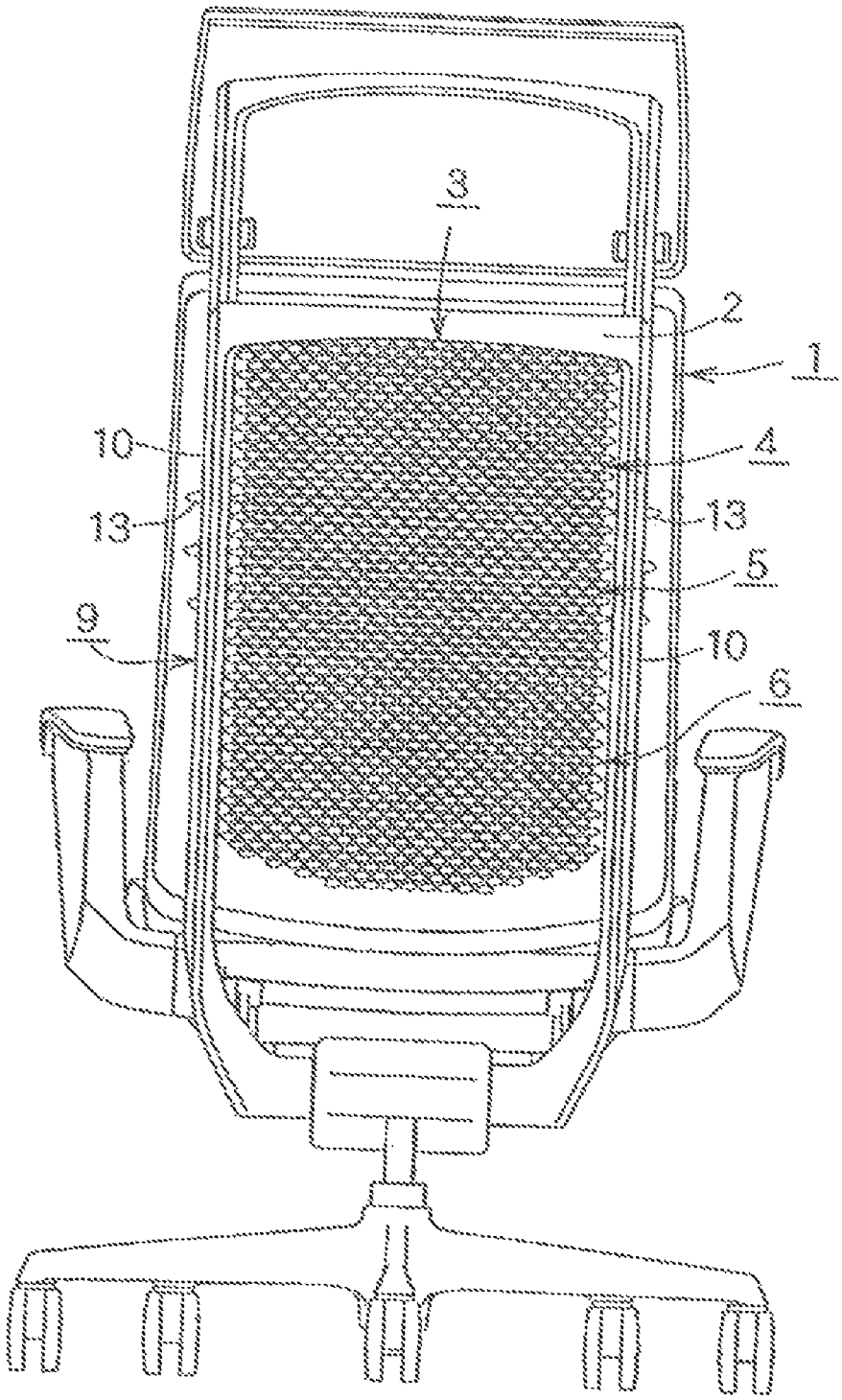
FIG. 1 is a rear elevational view of a chair comprising one embodiment of a base plate for a chair according to the present invention.
Figure 2:
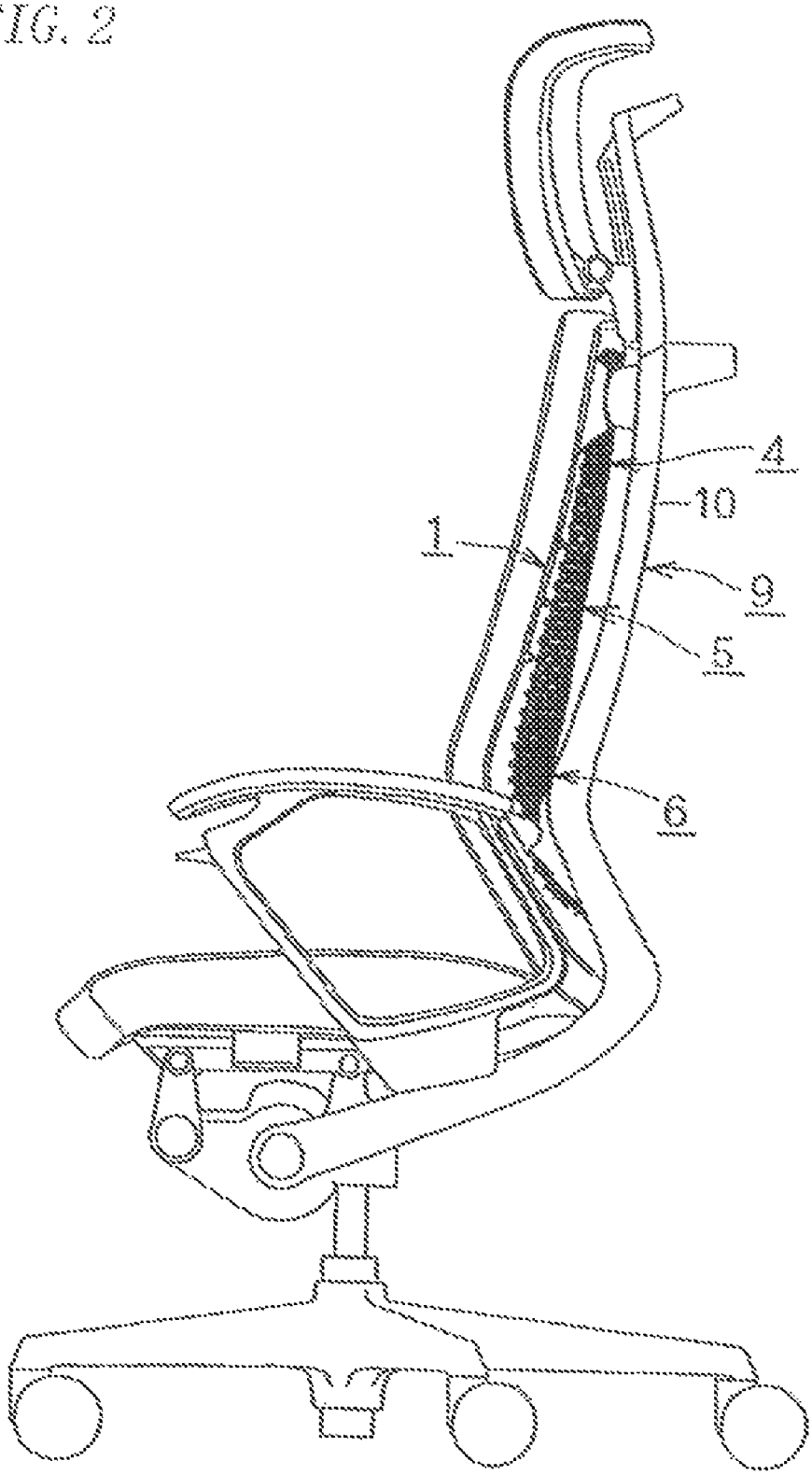
FIG. 2 is a side elevational view thereof.

A base plate 1 for the backrest of a chair comprises a shell made of metal or synthetic resin with deep drawing. A back support 3 or shell surrounded by a back frame 2 comprises an upper part 4, an intermediate part 5 and a lower part 6.

The upper part 4 and lower part 6 comprise a fine upper and lower mesh 7, while the intermediate part 5 comprises a coarse intermediate mesh 8.

The base 1 is mounted over the front surface of right and left side rods 10,10 of the back frame 9 with a pair of upper connectors 11 and a pair of lower connectors 12.

The intermediate part 5 supports the middle of the back of an occupant on the chair; the upper part 4 supports the upper back and shoulders; and the lower part 6 supports the lower back.

Figure 4:
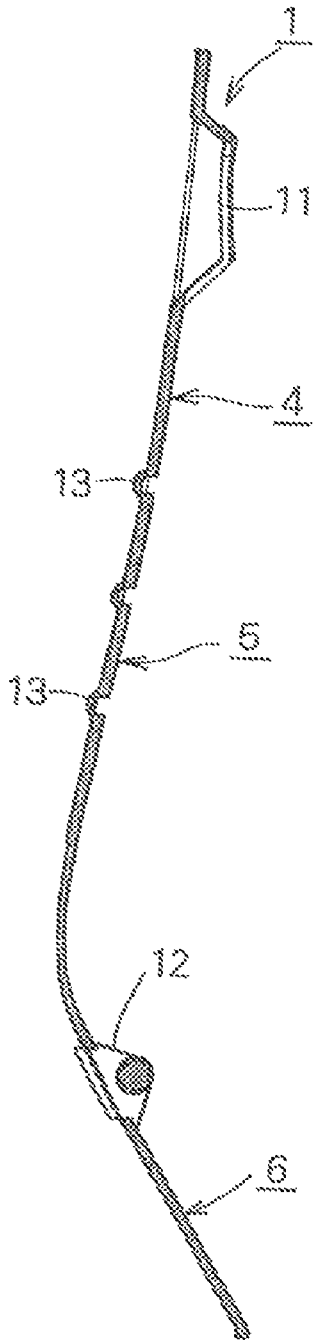
FIG. 4 is a vertical sectional side view taken along the line IV-IV in FIG. 3.

In FIG. 4, three flexible U-shaped portions 13 connect the side edge of the intermediate part 5 to the side of the back frame 2 to bend, expand and contract connecting parts of the intermediate part with the sides of the back frame 2 about the U-shaped portions 13.

Openings 14 in the upper and lower mesh 7, of the upper part 4 and lower part 6, are hexagonal and arranged like an X.

Thus, the upper part 4 and the lower part 6 can be bent depending on the shape of the back of the occupant. The upper and lower mesh 7 is variable in flexibility depending on its thickness and shape.

Intermediate openings 15, of the intermediate mesh 8 of the intermediate part 5, have a shape in which three openings 14 of the mesh 7 of the upper and lower parts 4, 6 are combined horizontally. The intermediate openings 15 are staggered vertically by a half and distributed uniformly. The intermediate part 5 has a lower flexural rigidity than the upper and lower parts 4, 6 and is thus more likely to bend. The flexibility of the intermediate mesh 8 is variable by changing thickness and the number of connections between the intermediate openings 15.

Figure 3:
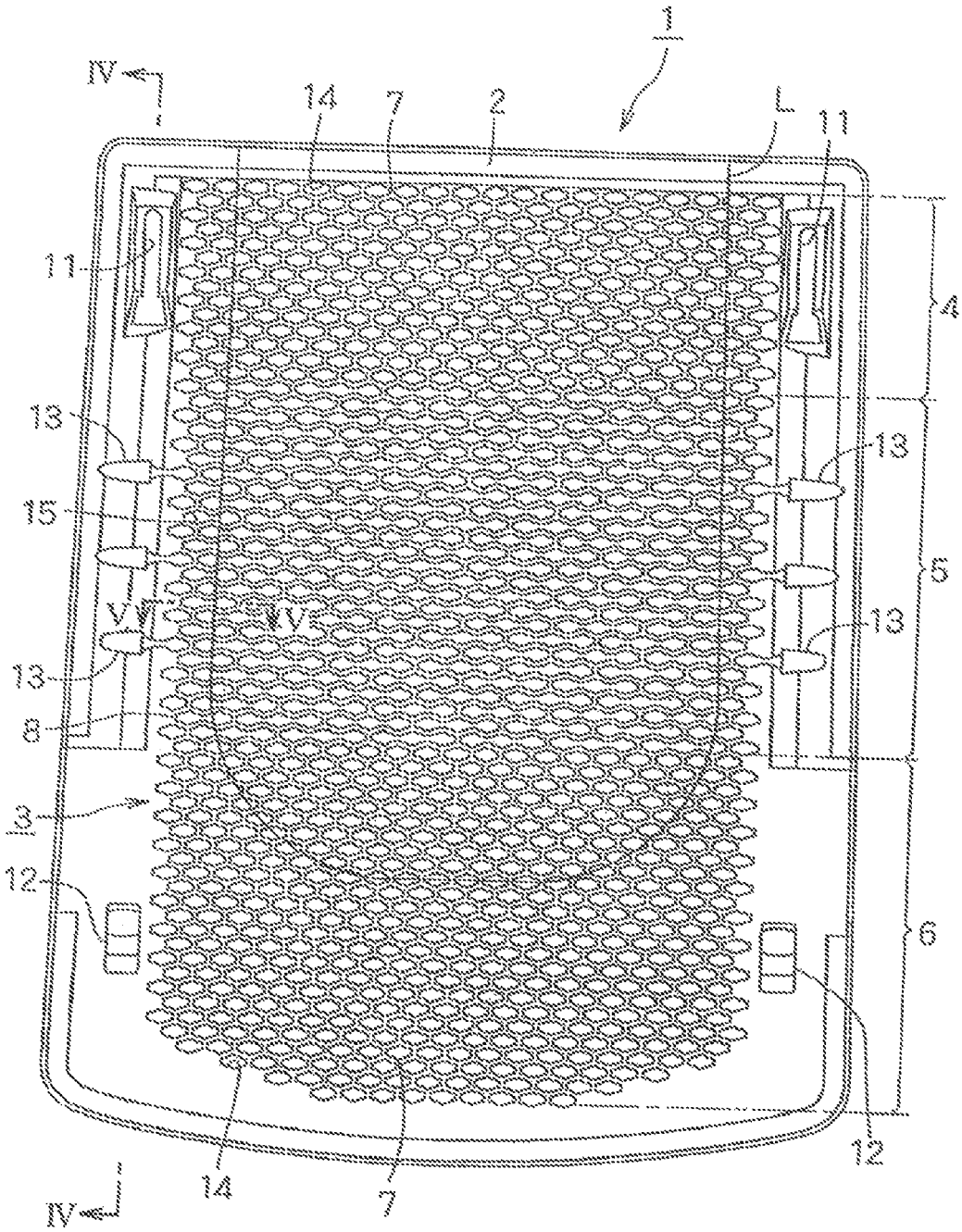
FIG. 3 is a front elevational view of a base plate for the chair.

In FIG. 3, the part surrounded by a U-shaped line L is thinner than the other parts comprising the sides of the upper part 4 and intermediate part 5, and a lower portion of the lower part 6. The part surrounded by the L supports the upper back of the occupant.

Figure 5:
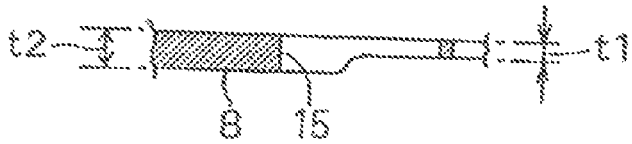
FIG. 5 is an enlarged horizontal sectional plan view taken along the line V-V in FIG. 3.

In this embodiment, in FIG. 5, the thickness t1 of the part surrounded by the line L is about 3 mm, while the thickness t2 of the other parts is about 4 mm. The part surrounded by the line L is concave.

As described above, in the embodiment, the opening 15 in the intermediate part 5 is longer along a width of the chair than the opening 14 of the upper and lower parts 4,6 to make coarse mesh. So the intermediate part 5 provides lower flexural rigidity than the upper and lower parts 4,6 and is likely to bend. The part supporting the upper back of the occupant is thinner than the other parts to allow the intermediate part 5 supporting the middle back of the occupant to vary in shape readily depending on the back of the occupant. The upper and lower parts 4,6 which support the shoulders and back of the occupant provide higher flexural rigidity and are unlikely to bend. Thus, the entire back of the occupant can suitably be supported to provide good comfort for sitting.

The present invention is not limited to use for the backrest, but may be applied to seats and bases of beds.

What is claimed is:

1. A base plate for a chair comprising:

an upper part having a plurality of first openings;

a lower part having a plurality of second openings, and the plurality of the first openings and the plurality of the second openings each being of substantially equal size; and an intermediate part between the upper part and the lower part, and the intermediate part having a plurality of third openings each of which is horizontally longer than each of the plurality of the first and the second openings;

wherein each of the plurality of the first and the second openings comprises a hexagon, and each of the plurality of the third openings has a shape in which a plurality of the first and second openings are substantially combined with one another, in a horizontal direction, to form third openings that are larger than each of the plurality of the first and second openings.

2. The base plate of claim 1, wherein the hexagon of each of the plurality of the first and the second openings has a length, in the horizontal direction, which is shorter than a length of each of the plurality of the third openings, in the horizontal direction, and each of the plurality of the third openings has a shape in which three of the first and the second openings are substantially combined with one another, along the horizontal direction, to form one of the plurality of the third openings.

3. The base plate of claim 1, wherein the base plate includes an upper middle part, sides of the upper part and sides of the intermediate part, and a lower portion of the lower part, and the upper middle part is thinner than the sides of the upper part, the sides of the intermediate part and the lower portion of the lower part.

4. The base plate of claim 1, wherein a plurality of flexible U-shaped portions connect a side edge of the intermediate part to a back frame surrounding the base plate.

5. The base plate of claim 1, wherein the upper part, the intermediate part and the lower part are integrally molded of synthetic resin.

6. A base plate for a chair comprising:

an upper part having a plurality of first openings;

a lower part having a plurality of second openings, and the plurality of the first openings and the plurality of the second openings being of substantially equal size; and an intermediate part between the upper part and the lower part, and the intermediate part having a plurality of third openings each of which is horizontally longer than each of the plurality of the first and the second openings;

wherein each of the plurality of the first and the second openings comprises a hexagon; the hexagon of each of the plurality of the first and the second openings has a length, in the horizontal direction, which is shorter than a length of each of the plurality of the third openings, in the horizontal direction, and each of the plurality of the third openings has a shape in which three of the first and the second openings are substantially combined with one another, along the horizontal direction, to form third openings that are larger than each of the plurality of the first and the second openings.

* * * * *